US008587446B2

(12) United States Patent
Hefferon

(10) Patent No.: US 8,587,446 B2
(45) Date of Patent: Nov. 19, 2013

(54) DYNAMIC OCCUPANCY MONITORING

(76) Inventor: Matthew Thomas Hefferon, Redmond, WA (US)

( * ) Notice: Subject to any disclaimer, the term of this patent is extended or adjusted under 35 U.S.C. 154(b) by 394 days.

(21) Appl. No.: 12/873,748

(22) Filed: Sep. 1, 2010

(65) Prior Publication Data

US 2011/0050442 A1 Mar. 3, 2011

Related U.S. Application Data

(60) Provisional application No. 61/239,006, filed on Sep. 1, 2009.

(51) Int. Cl.
*A47C 7/62* (2006.01)

(52) U.S. Cl.
USPC ..... 340/679; 340/667; 340/665; 340/666; 340/686.1; 340/319.16; 297/217.3; 297/217.4

(58) Field of Classification Search
USPC ..... 297/217.3, 217.4
See application file for complete search history.

(56) References Cited

U.S. PATENT DOCUMENTS

| | | | | |
|---|---|---|---|---|
| 5,555,458 | A | 9/1996 | Large | |
| 5,797,126 | A | 8/1998 | Helbling et al. | |
| 5,893,608 | A * | 4/1999 | Cravenor | 297/217.3 |
| 6,025,783 | A * | 2/2000 | Steffens, Jr. | 340/644 |
| 6,140,921 | A * | 10/2000 | Baron et al. | 340/540 |
| 6,782,988 | B2 | 8/2004 | Cantacuzene et al. | |
| 6,870,477 | B2 * | 3/2005 | Gruteser et al. | 340/573.1 |
| 7,598,881 | B2 * | 10/2009 | Morgan | 340/667 |
| 8,170,745 | B1 * | 5/2012 | Lors | 701/36 |
| 8,253,553 | B2 * | 8/2012 | Wedig et al. | 340/522 |
| 2003/0069789 | A1 | 4/2003 | Gathman et al. | |
| 2004/0158865 | A1 * | 8/2004 | Kubler et al. | 725/82 |
| 2008/0024324 | A1 | 1/2008 | Adamczyk et al. | |
| 2008/0143512 | A1 * | 6/2008 | Wakisaka et al. | 340/504 |
| 2011/0050442 | A1 * | 3/2011 | Hefferon | 340/679 |

* cited by examiner

*Primary Examiner* — George Bugg
*Assistant Examiner* — Munear Akki
(74) *Attorney, Agent, or Firm* — Seed IP Law Group PLLC

(57) ABSTRACT

The present disclosure is directed to systems and methods for monitoring and displaying occupancy of a seating area, such as a theater. In a seating area there are chairs for use by patrons. There is a system and method for determining and communicating occupancy information to a display corresponding to the chairs in the seating area. On each chair there is affixed a wireless sensing device that detects when a patron has sat in the chair. When a patron sits in the chair, the wireless sensing device sends an occupied signal to an occupancy monitoring computer system. The occupancy monitoring system changes the status of the corresponding chair to occupied and updates the output on the display available for viewing by all patrons. When the occupied state of the chair changes, the wireless sensing device updates the occupancy status at the occupancy monitoring system.

20 Claims, 7 Drawing Sheets

DYNAMIC OCCUPANCY MONITORING

CROSS-REFERENCE TO RELATED APPLICATION

This application claims the benefit under 35 U.S.C. §119(e) of U.S. Provisional Patent Application No. 61/239,006 filed Sep. 1, 2009, where this provisional application is incorporated herein by reference in its entirety.

BACKGROUND

1. Technical Field

The disclosed subject matter relates to systems and methods for dynamically monitoring a plurality of physical spaces that may be occupied, and more particularly, to systems and methods for providing information about which of the plurality of spaces are currently occupied or unoccupied.

2. Description of the Related Art

A common problem with movie theater seating is that it is dark inside the theater thus making it difficult to find available chairs. After a patron or group of patrons enters, they must stand in the dark for a few moments looking at the chairs to find which ones are open and which ones are taken. Then, once they determine the open chairs, they must select a set of chairs that fits their group size, whether it be 2, 4, 8, or some other size as well as their chair location preference. Such chair selection takes time and can currently only occur in the movie theater room itself. Further, the patrons may stand in the aisles when searching for chairs, potentially blocking others from getting to their chairs, or even blocking the views of others. This causes considerable inconvenience to others and embarrassment to the patrons while they try to locate their chairs.

BRIEF SUMMARY

There is disclosed a method including transmitting an occupied signal to a computing device when a moveable seat of a chair has moved to a first position. Upon sensing that the moveable seat of the chair has moved to the first position a timer is activated. Based on the occupied signal and the timer reaching a first threshold, changing a status of the chair from available to occupied.

There is a system that includes a sensing device attached to a chair. When a moveable seat of the chair is moved to a first position, a timer is activated and an occupied signal is transmitted to a computing device. The computing device updates a display device with the occupancy status of the chair when the sensing device transmits the occupied signal to the computing device and the timer reaches a first threshold.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn are not intended to convey any information regarding the actual shape of the particular elements, and have been selected solely for ease of recognition in the drawings.

DETAILED DESCRIPTION

Embodiments described herein provide enhanced computer- and network-based methods, techniques, and systems for dynamically monitoring a plurality of physical spaces, such as chairs, within a seating area. Examples of seating areas include a movie theater, performance hall, convention center seating, an opera house, a stadium, an arena, a transport vehicle (e.g., an airplane, bus, ferry, etc.). Example embodiments provide an occupancy monitoring system that is operable to dynamically determine which of a plurality of spaces within the seating area are currently occupied and unoccupied (i.e., the occupancy status) and provide information corresponding to the occupancy status of each of the plurality of spaces to one or more patrons. In particular, such an occupancy monitoring system may dynamically determine the occupancy status of a plurality of chairs within the seating area in a substantially real-time manner, such as at or near a time when one or more of the chairs change their occupancy status.

Figure 1:
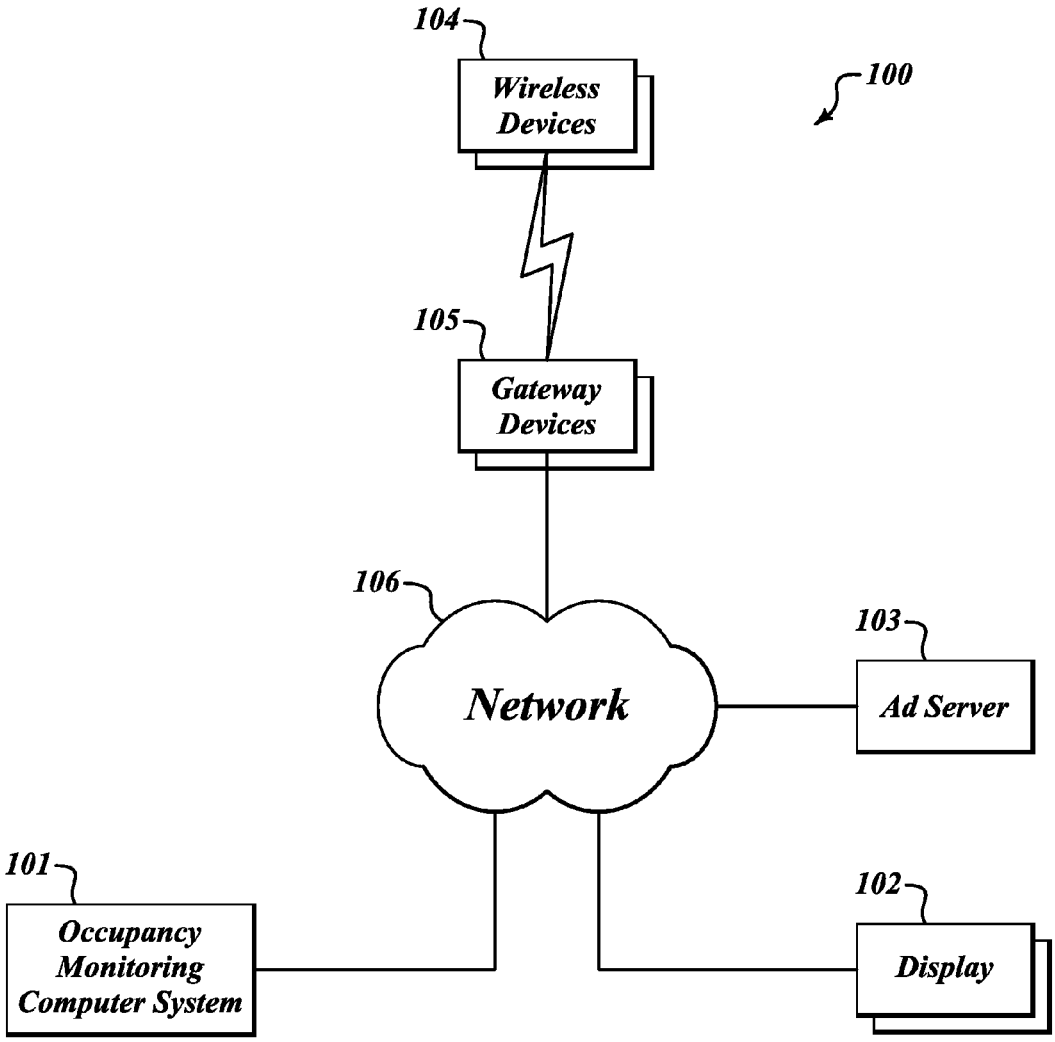
FIG. 1 is a schematic diagram illustrating an embodiment of an occupancy monitoring system.

FIG. 1 shows an occupancy monitoring system 100 according to one embodiment of the present disclosure. According to this embodiment, the occupancy monitoring system 100 includes an occupancy monitoring computer system 101, one or more displays 102, an advertisement server 103, one or more wireless devices 104, and one or more gateway devices 105 connected through network 106. The occupancy monitoring system 100 monitors the occupancy status of chairs (not shown) in one or more seating areas (not shown). Each chair is coupled with one of the wireless devices 104.

It should be appreciated that the occupancy monitoring system 100 is not limited to chairs in a seating area. In other embodiments, the occupancy monitoring system 100 may monitor parking spots, storage locations in a storage area, boat docks, or the like. In these other embodiments, the wireless devices 104 would be modified for use in their particular environment. For example, in a boat dock setting, there is water everywhere, so the wireless devices 104 would have to be either sheltered from water (and the environment) or be waterproof.

In a preferred embodiment, the occupancy monitoring computer system 101 monitors the occupancy status of the chairs in their respective seating areas through messages received from and transmitted back to the wireless devices 104 through the network 106. In one embodiment, the occupancy monitoring computer system 101 stores and processes the messages using a memory and a processor (not shown), respectively. The memory and processor of the occupancy monitoring computer system 101 may be of any type of memory and processor capable of storing and processing computer readable instructions stored in the memory. The instructions are programmed to cause the occupancy monitoring computer system 101 to monitor the occupancy status of the chairs.

According to a preferred embodiment, the occupancy monitoring computer system 101 receives the messages from the wireless devices 104 in response to activity at the chairs. For each of the wireless devices 104, the occupancy monitoring computer system 101 stores and updates the respective occupancy status for a corresponding chair. In one embodiment, the messages from the wireless devices 104 are transmitted to a respective gateway device 105 that is connected to a network 106. There is at least one gateway device 105 in each seating area monitored by the occupancy monitoring computing system 101. The gateway devices 105 may be wireless routers or hubs, or other wireless connection devices that can receive and transmit to multiple wireless devices, such as wireless devices 104, and are also connected to the network 106.

The network 106 may take a variety of forms. For instance, the network 106 may include wired, wireless, optical, or a combination of wired, wireless and optical communications links. In addition, the network 106 may include public networks, private networks, unsecured networks, secured networks or combinations thereof, and may employ any one or more communications protocols, for example TCP/IP protocol, UDP protocols, IEEE 802.11 protocol, as well as other telecommunications or computer networking protocols.

According to one embodiment, the occupancy monitoring computer system 101 communicates the occupancy status of each chair to the displays 102 through the network 106. In one embodiment, each display 102 may include a processor and a memory (not shown), where the memory includes computer readable medium instructions for causing the processor of the display 102 to execute a program that processes the occupancy status information received from the occupancy monitoring computer system 101.

In the present embodiment, when a display 102 receives status information from the occupancy monitoring computer system 101 regarding a corresponding seating area and at least one chair within the corresponding seating area, the processor executes the computer readable medium instructions causing the displays 102 to display the occupancy status for each chair in a corresponding seating area. For example, the occupancy status information for each chair may simply be a message indicating that the chair is occupied, reserved, or available. In this embodiment, based on the occupancy status of each chair, the processor of the display 102 will store the occupancy status of the respective chair in the memory and update that information on the screen of the display 102, if necessary.

In an alternative embodiment, the displays 102 operate only as displays for displaying information transmitted to them from the occupancy monitoring computer system 101. In this embodiment, the occupancy monitoring computer system 101 processes the occupancy status information received from the wireless devices 104 attached to each chair in the seating area. The occupancy status of each chair is stored in a memory in the occupancy monitoring computer system 101 and processed by a corresponding processor. The occupancy monitoring computer system 101 generates information corresponding to display information from the stored occupancy status information for a respective display of the displays 102. The generated information is sent from the occupancy monitoring computer system 101 to the displays 102.

In one embodiment, the generated information may be outputted from a video or graphics card of the occupancy monitoring computer system 101, which may include a picture image including a chair arrangement of the seating area and which chairs are occupied, reserved, or available. The occupancy monitoring computer system 101 updates the picture image at regular intervals so as to keep the information on the displays 102 current.

In an alternative embodiment, the occupancy monitoring computer system 101 may output a video type signal to the displays 102 with the occupancy status information for the respective seating area. This output is similar to an output from a computer to a monitor or could be any type of video output signal causing a screen to display the output in graphical form.

According to another embodiment, additional information may be displayed on the displays 102. In a preferred embodiment, the additional information displayed on the displays 102 is advertisement information from local or national advertisers. In one embodiment, the advertisement information is communicated from an advertisement server 103. The advertisement server 103 may be local or remote. For example, the advertisement server 103 may be part of a remote server that administers advertisement data to theaters or the like. Alternatively, the advertisement server 103 may be a local server or part of the occupancy monitoring computer system 101 in which advertisement information is entered on a regular basis so that it may be displayed on the displays 102.

According to other embodiments, the additional information may be information other than advertising data, such as relevant data regarding the current event taking place in the respective seating area, such as the current movie playing and the time it will start. It should also be appreciated that any type of information may be displayed on the display 102 in addition to the occupancy status information for the chairs in the respective seating area. For example, personalized messages may be shown on the displays 102, such as, "Happy Halloween!" or "Merry Christmas" or even more personalized messages paid for by an individual, such as "Will you marry Darlene?"

It should be appreciated that the displays 102 may take a variety of forms, such as personal digital assistants (PDAs), smart phones, iPhones, Blackberries, etc., and may communicate requests for occupancy status information with the occupancy monitoring computer system 101 wirelessly, such as via the network 106 or other network to which the displays 102 are connected.

Figure 2:
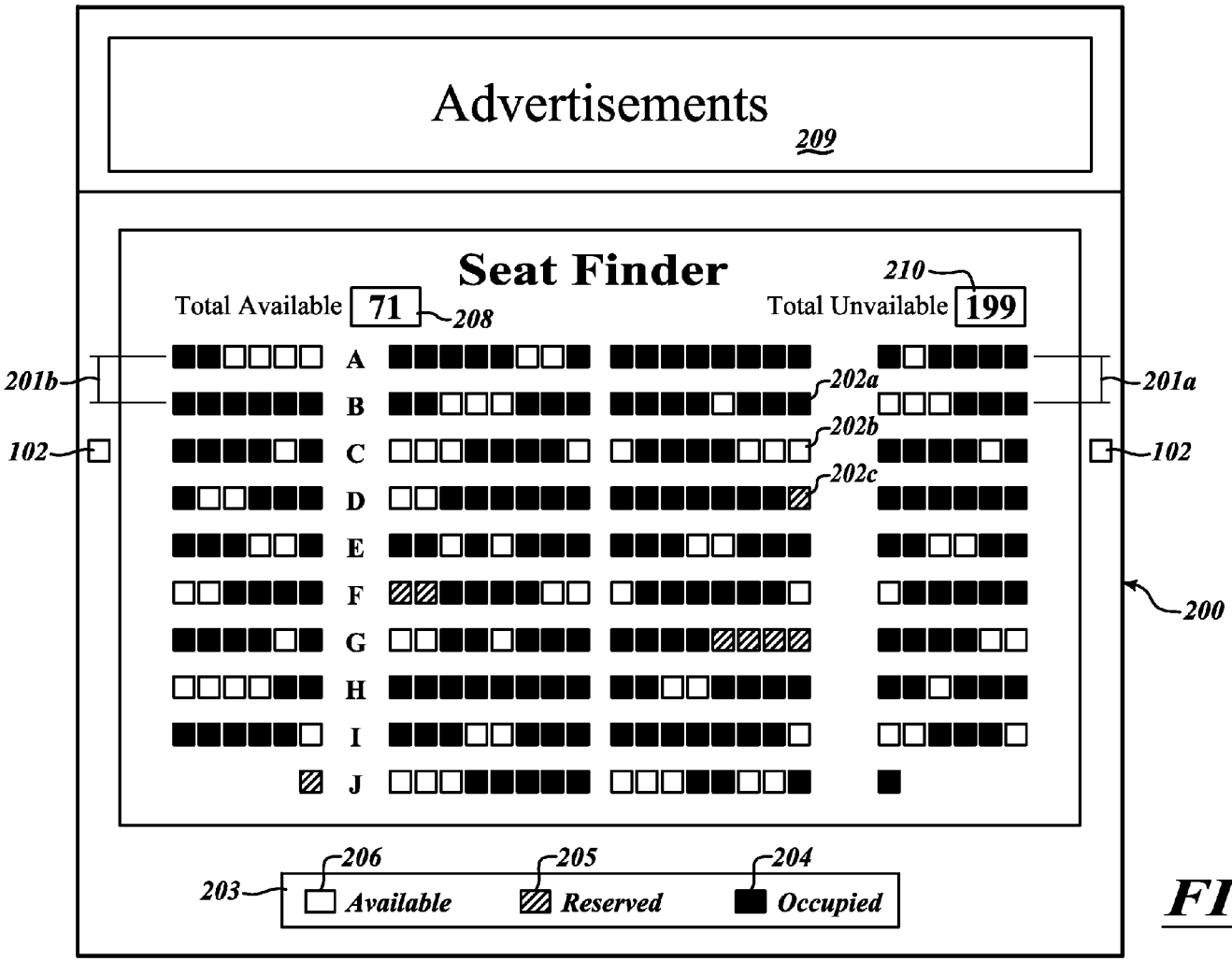
FIG. 2 is a screen display for an occupancy monitoring system, according to one illustrated embodiment.

FIG. 2 shows an enlarged view of a screen 200 according to a preferred embodiment of the disclosed subject matter. The screen 200 is a screenshot of what a patron outside a seating area, as discussed above, might see on the corresponding display 102. The screen 200 shows a seating layout for a seating area, such as a movie theater, concert hall, entertainment venue, or the like. There are icons corresponding to the displays 102 on the screen 200 showing the physical location of the displays 102 near seating area doors 201*a* and 201*b* to serve as reference points for patrons viewing the screen 200.

The screens 200 may take a variety of forms, such as LCD, LED, CRT, touch screen, projection screen, etc., and may be communicatively coupled to the occupancy monitoring computer system 101 directly, e.g., via a cable, or via a network, such as the network 106. In other embodiments, the occupancy monitoring computer system 101 and the screens 200 may be integrated into a single component, such as a single display, a kiosk, etc. Alternatively, occupancy status information can be broadcast locally in the seating area so that patrons about to enter the seating area, whether a movie theater or a parking garage, can look at the screen on their PDA and see where the unoccupied chairs are located and make a decision as to where to sit.

According to one embodiment, the displays 102 as seen in FIG. 2 may further include a special marking indicating that the present screen 200 being viewed corresponds to the display 102 as marked on the screen 200. The purpose of such an additional marking is to allow patrons to know where they are currently located. As an example, the display 102 currently associated with the screen 200 may be highlighted a different color, marked with a star or other symbol, or marked with the words "You Are Here", etc.

In one example, the screen 200 may be a touch screen mounted on a steel stand outside the seating area, such as at locations 102 as seen in FIG. 2. Alternatively, the screen 200 may be a monitor, such as a flat panel display or the like, that is not interactive like a touch screen. As a patron approaches the screen 200, the screen 200 may be in a screen saver mode. When the patron touches the screen 200, the screen saver mode is exited and a layout of the theater seating area and the corresponding chairs appears allowing the patron to determine which chairs best suit his or her needs. In another embodiment, the screen 200 may be in a screen saver mode and activated not by touch, but by sensing that a patron has approached the screen. This may be done with a motion sensor attached to the displays 102.

The screen 200 further shows each of the chairs in the seating area. By way of example, chairs 202*a*, 202*b*, and 202*c* show the three different occupied states in which a chair may exist. There also exists a legend 203 that informs the patron as to what the different markings on each chair mean. In one example, chair 202*a* is fully shaded or an indicative color, such as red, to signify that the chair 202*a* is occupied, as further indicated by the occupied legend indicator 204. Chair 202*b* has no shading at all, or is of a bright color, such as green, to signify that the chair 202*b* is available, as is also indicated by the available legend indicator 206. Lastly, chair 202*c* is slightly shaded, or is of a different color than either chairs 202*a* or 202*b*, such as yellow, to indicate that the chair 202*c* is reserved, as is indicated by the reserved legend indicator 205. In this way, it is possible for a patron to easily and quickly determine available chairs within the seating area before entering the seating area.

In an alternative embodiment, there may also be indicated on the screen 200 that some chairs, or areas, in the seating area are special seating, e.g., handicap seating, crying room seating, or the like. These special seating chairs would also be subject to the same occupancy status indications as the other seats, but have a further indication that they are reserved for those patrons with specific needs.

In the present embodiment, because the chair 202*a* is occupied, an object, usually a patron, is currently physically sitting in the chair. When no patron is currently sitting in the chair, the chair is available and displayed as the chair 202*b*. When a chair is reserved, such as the chair 202*c*, it means that a patron was sitting in the chair, but has gotten up temporarily. The reserved state of a chair is entered from an occupied state of the chair. According to an aspect of the present embodiment, a chair changes occupancy status to a reserved state from an occupied state when a patron sitting in that chair stands up. There are many reasons a patron may stand up from his or her chair. These include, to stretch, use the restroom, visit a concession stand, visit with other patrons in the seating area, or the like.

When a patron stands up from the chair, especially for the purpose of leaving the seating area temporarily to visit the restroom or the concession stand, the patron wants to ensure that his or her chair will be available when he or she returns. But since the chair is neither occupied nor available, the chair is indicated as reserved on the screen 200. In a preferred embodiment, a chair remains reserved for a length of time sufficient to allow the patron to use the restroom or visit the concession stand, but not so long as to keep the chair in a reserved status indefinitely. For example, a range of between 5 and 10 minutes is an average amount of time for a patron to be temporarily away from his or her chair. The amount of time may be adjusted, however, depending on the seating area and the type of event the patron is attending.

According to the present embodiment, the screen 200 also has a total chairs available indicator 208 and total chairs unavailable indicator 210. The total chairs available indicator 208 is a count of the number of chairs in the seating area that are available for use. The available chairs correspond to those chairs identified by the type of marking associated with the available legend indicator 206. The total chairs unavailable indicator 210 is a count of the number of chairs in the seating area that are unavailable for use. The unavailable chairs include those chairs that are indicated as occupied and those chairs that are indicated as reserved according to the occupied and reserved legend indicators 204 and 205.

Screen 200 also has a section 209 used for additional display information. The section 209 may be used for advertisements, interactive user controls that allow access to other additional functionality, special messages, or the like as previously described. As seen in FIG. 2, the section 209 is located above the seating area display, but may be placed at other locations on the screen 200, such as below the seating area display. This may help in maximizing the area of the screen 200 to best utilize the space on the screen or to accommodate a seating area that is shaped differently, such as a horn, oval, or semi-circular seating area shape.

Figure 3A:
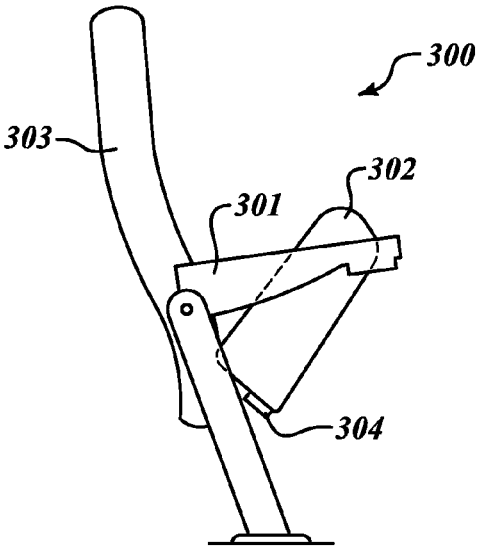
FIGS. 3A-3C are examples of a chair in various states, including occupied, reserved, and available in an occupancy monitoring system.
Figure 3B:
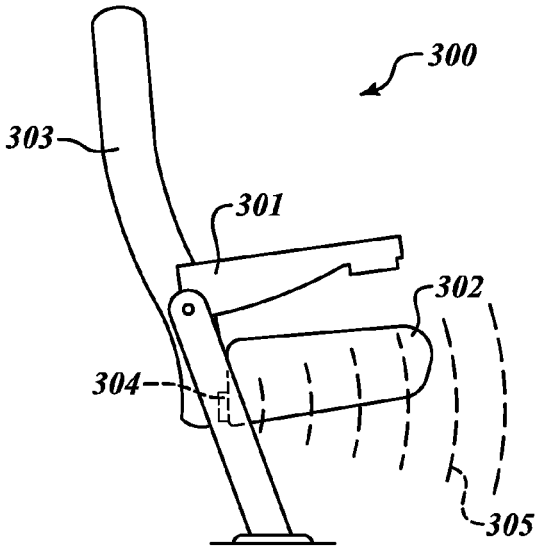
Figure 3C:
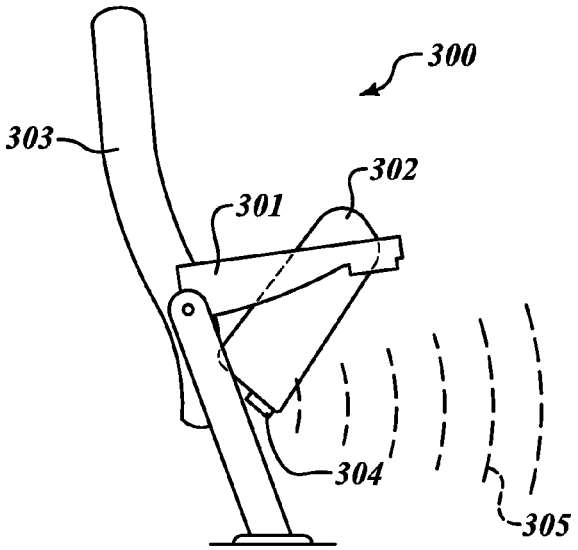

In the embodiment of FIG. 2, the occupancy status of the chairs of the seating area are updated at regular intervals by the occupancy monitoring computer system 101 as seen in FIG. 1. In a preferred embodiment, each chair in the seating area is equipped with a wireless device 104 that communicates the occupancy status information to the occupancy monitoring computer system 101 through the network 106. As seen in FIGS. 3A-3C there is an example of a chair 300 that is used in a seating area as previously described.

According to a preferred embodiment as seen in FIGS. 3A-3C, there is a chair 300 that is a typical chair, such as a theater chair, that is attached to the seating area floor and has arm rests 301, a seat 302, and a back 303. Attached to the seat 302 is a wireless sensing device 304. The wireless sensing device 304 is designed to determine when a patron is sitting in the chair 300. In a preferred embodiment, the wireless sensing device 304 is attached to the back of the seat 302. In this location, the wireless sensing device 304 is hidden from view of other patrons and relatively protected from unauthorized tampering. Additionally, placing the wireless sensing device 304 on the back of the seat 302 allows easy access for repairs, routine maintenance, and replacement. It should be appreciated, however, that the wireless sensing device 304 may be placed at any suitable location on the chair 300 so as to detect movement of the seat 302. For example, the wireless sensing device 304 may be placed on the bottom of the seat 302, inside the seat 302, inside the back 303, etc.

The wireless sensing device 304 operates to detect a position of the seat 302 and determine a status of the chair 300. The wireless sensing device 304 may be of any type of sensor including, tilt, motion, pressure, or the like. Thus, the wireless sensing device 304 may be of a variety of sensing devices and placed in a variety of different locations on the chairs 300. For example, if the wireless sensing device 304 is in the seat 302, it may sense when a patron has sat in the chair 300 through a pressure sensor. In another embodiment, as seen in FIGS.

3A-3C, when the wireless sensing device 304 is located on the back of the seat 304, and may be a tilt or motion sensor. When the chair 300 is in an available state, the wireless sensing device 304 will detect that the seat 302 is in an upright position.

When the seat 302 moves to a position in which a patron may sit in the chair 300, as seen in FIG. 3B, the chair 300 is in the occupied state. As the seat 302 is moved to the position as seen in FIG. 3B, the wireless sensing device 304 determines that the seat 302 has been moved and information regarding a change in the occupancy status is transmitted from the wireless sensing device 304 to the occupancy monitoring computer system 101. The wireless sensing device 304 preferably communicates using wireless signals 305, but it should be appreciated that wired communication is also possible and considered within the scope of the present disclosure. For example, the wireless sensing device 304 may cause another sensor that is fixed to the back 303 of the chair 300 to activate a signal identifying the occupancy status of the chair 300 has changed. The sensor fixed to the back 303 may be connected to the occupancy monitoring computer system 101 by wires.

As seen in FIG. 3C, there is a situation in which a patron has stood up from the chair 300 after the occupancy status of the chair 300 has been changed to an occupied state. As a result, the seat 302 is moved from the seated position to the upright position. The wireless sensing device 304 senses the movement of the seat 302 and transmits a wireless signal 305 to the occupancy monitoring computer system 101 indicating that the seat 302 has moved from an occupied state to a reserved state. As will be described below, there is a period of time that the chair 300 is considered to be in a reserved state, for example, when a patron has gone to the restroom or the concession stand. After this period of time has elapsed and the patron has not returned, then the status of the chair 300 will be changed from a reserved state to an available state in the occupancy monitoring computer system 101, which is further reflected at the corresponding chair on the screen 200.

Figure 4A:
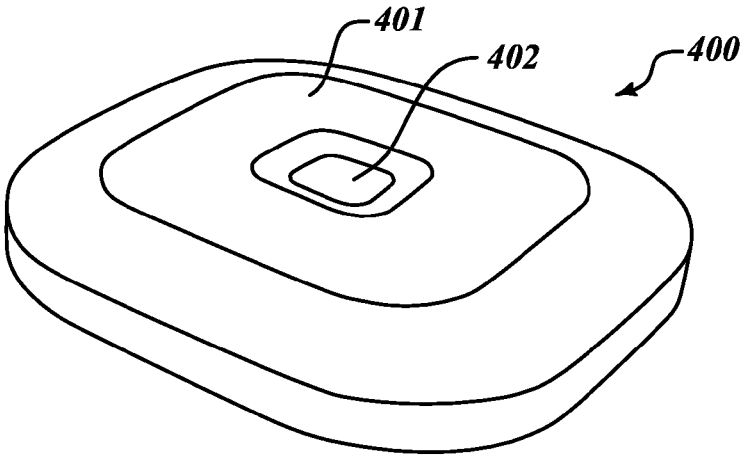
FIGS. 4A-4C are examples of various embodiments of a wireless sensing device attached to the chair as shown in FIGS. 3A-3C.
Figure 4B:
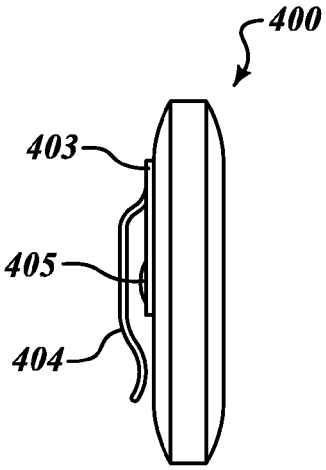
Figure 4C:
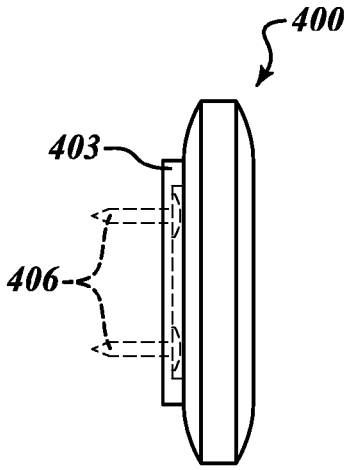

An example of the wireless sensing device 304 is further seen in FIGS. 4A-4C as device 400. FIG. 4A shows the device 400 in a perspective view according to one embodiment. In this embodiment, the device 400 is a rectangular shaped device, but may be of other shapes. The device 400 has a top portion 401 that has a hole 402 to allow wireless signals to be transmitted and received. Alternatively, the top portion 401 of the device 400 may not have a hole 402 and be fully enclosed but still capable of transmitting and receiving wireless signals. The device 400 is of a size small enough to be easily hidden from view when attached to the chair 300, yet large enough to be easily accessed for repairs and other maintenance, such as replacing a battery.

In several embodiments, the device 400 may feature small form factor, low cost, long battery life, robust security and high data reliability. In some such embodiments, the device 400 may communicate using a wireless protocol, such as 802.11, Bluetooth, the ZigBee protocol, or the like.

As seen in FIG. 4B, there is a side view of the device 400, the device 400 has a back securing portion 403. There is a clip 404 fastened to the back securing portion 403 used to clip the wireless sensing device 400 to the chair 300. There is also shown a fastening device 405, such as a small screw, to fasten the back securing portion 403 to the device 400.

In an alternative embodiment as seen in FIG. 4C, the back securing portion 403 may have other forms of securing portions, such as a screw securing portion 406, an adhesive securing portion, an interlocking securing portion that locks into a separate securing portion permanently fixed to the chair 300, or the like. Any of the other forms of securing portions may be attached to the device 400 by the fastening means 405, or other suitable fastening means.

It should also be appreciated that the wireless sensing device 400 may be any type of sensing device that identifies occupancy of the chair 300. For example, in a preferred embodiment, the wireless sensing device 400 may be a tilt sensor that detects a change in the angle or height of the seat 302. When the seat 302 is moved to an almost horizontal position to support a patron, the wireless sensing device 400 detects that the seat 302 has moved from a position as seen in FIG. 3A to a position as seen in FIG. 3B. Upon sensing the movement, the wireless sensing device 400 sends a wireless communication to the occupancy monitoring computer system 101. Alternatively, the wireless sensing device 400 can be a motion sensor that detects the actual movement of the seat 302, a magnetic sensor that is activated as it comes into close proximity with another magnetic portion that may be attached to the back 303 of the chair 300, such as near the bottom of the back 303, or any other sensor capable of detecting occupancy of the chair 300.

Figure 5:
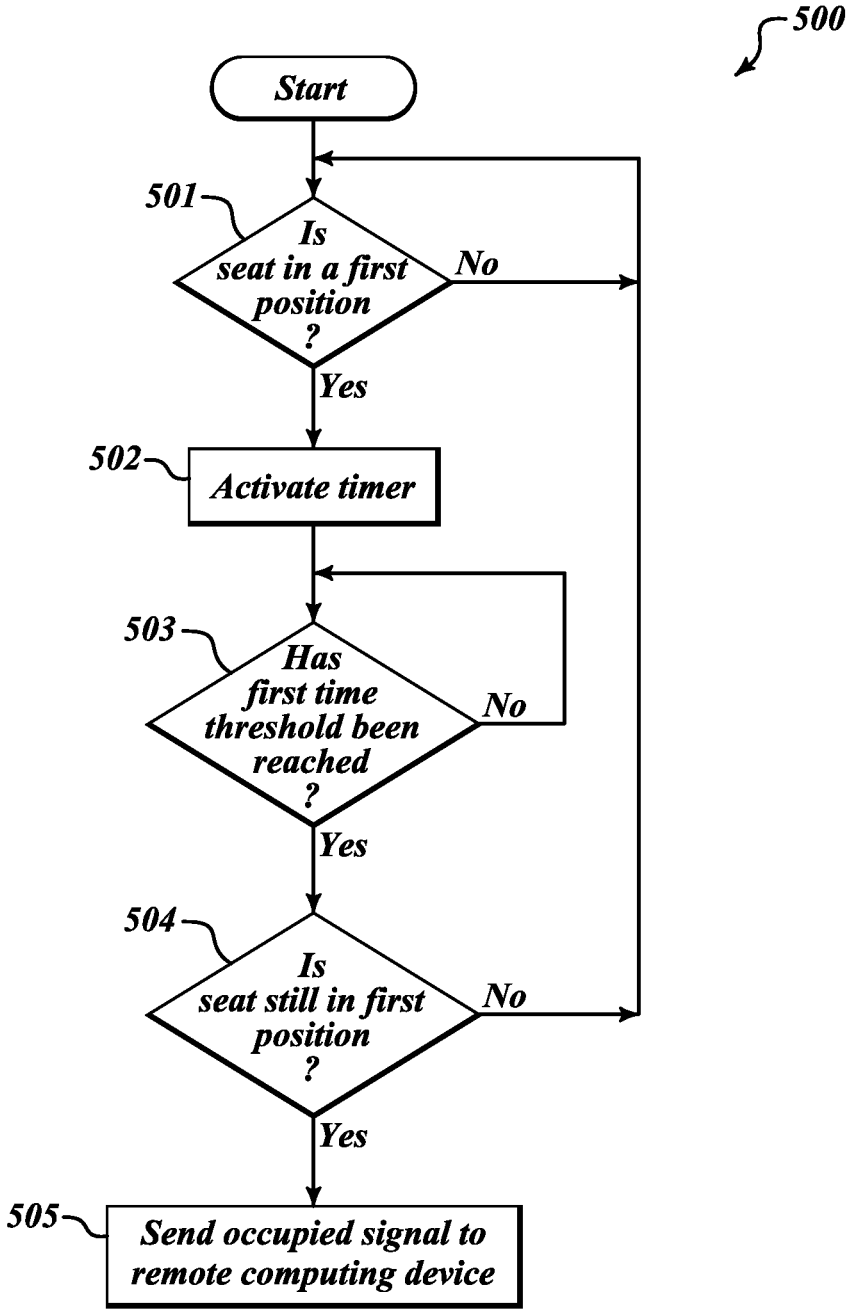
FIG. 5 is a method of determining when a chair is occupied.

According to a preferred embodiment, there is disclosed a method for the occupancy monitoring system 100 that operates to monitor the occupancy status of chairs in a number of seating areas. As seen in FIG. 5, there is a method 500 for determining when a chair 300 has entered an occupied state from an available state. At step 501 a determination is made as to when the seat 302 has been placed in a first position, ready for use by a patron. If no such determination is made at step 501, the wireless sensing device 304 does nothing and waits until the seat 302 has been moved to the first position.

If it is determined at step 501 that the seat 302 has been moved to the first position, then a timer is activated at step 502. According to one embodiment, the timer is housed within the wireless sensing device 304. In an alternative embodiment, the timer is housed in the occupancy monitoring computer system 101. According to this embodiment, a wireless signal is transmitted from the wireless sensing device 304 to the occupancy monitoring computer system 101, where the wireless signal indicates that a timer is to be started. When the occupancy monitoring computer system 101 receives the wireless signal, the timer is started.

After the timer has been started, it is determined at step 503 if the timer has reached a first time threshold. If the timer has not yet reached the first time threshold, then the timer continues to run. Otherwise, if the timer has reached the first time threshold and if the timer is housed within the occupancy monitoring computer system 101, then the occupancy monitoring computer system 101 will send a wireless signal to the wireless sensing device 304 indicating the timer has expired. When either the wireless sensing device 304 has received the wireless signal from the occupancy monitoring computer system 101, or the wireless sensing device 304 has determined that the timer has expired, the wireless sensing device 304 checks to see that the seat 302 remains in the first position at step 504.

If the seat 302 has moved from the first position, that is, it is now as shown in FIG. 3A, then the occupancy status of the chair 300 will remain in an available state and the method 500 will start over. If the seat 302 has not moved from the first position, then the wireless sensing device 304 sends an occupied state signal to the occupancy monitoring computer system 101 at step 505. It should be appreciated that the occupied state signal will have appropriate chair and wireless device identifying information so that the occupancy monitoring computer system 101 can update the occupancy status of the correct chair 300 in the correct seating area. This information may include a destination identifier, a source identifier, or the like.

In an alternative embodiment, the steps 502, 503, and 504 may be skipped altogether. In one aspect of this embodiment, after the wireless sensing device 304 determines that the seat 302 has moved to the first position at step 501, the wireless sensing device 304 may send the occupied state signal to the occupancy monitoring computer system 101 without activating a timer or checking that the seat 302 has moved from the first position. According to this embodiment, the occupancy monitoring system 101 assumes that the chair 300 is in the occupied state and only changes the occupancy status information if a reserved state signal is received, as described with regard to FIG. 6.

Figure 6:
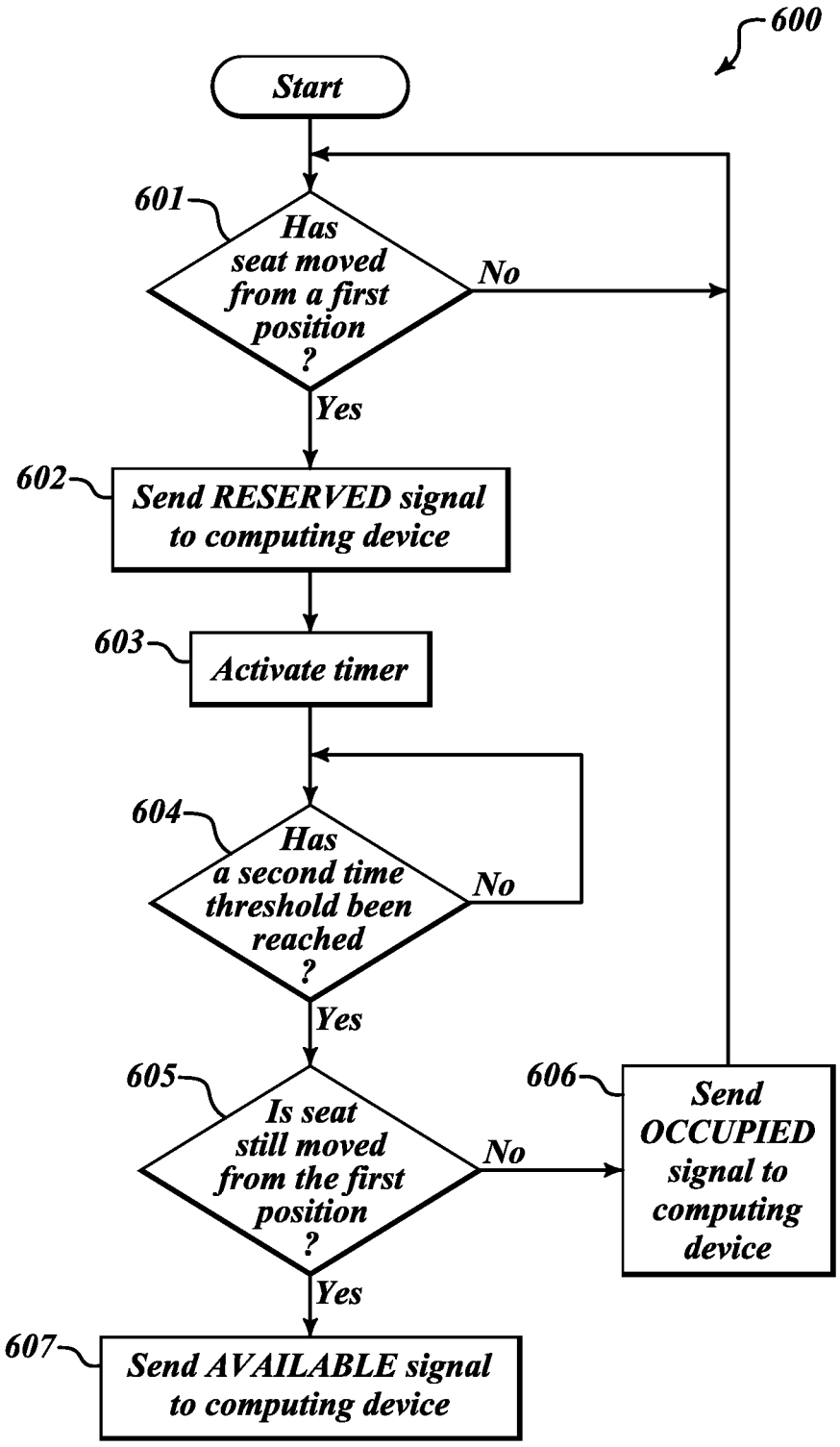
FIG. 6 is a method of determining when a chair is unoccupied.

As seen in FIG. 6, there is a method 600 for determining when a chair 300 is in a state other than occupied. The method 600 is started when a chair 300 is in an occupied state and the seat 302 is in the first position, as seen in FIG. 3B. At step 601 of the method 600, the wireless sensing device 304 senses when the seat 302 has moved from the first position, that is, when the chair 300 is not in an occupied state. When it is sensed that the seat 302 is no longer in an occupied state, a reserved state signal is sent to the occupancy monitoring computer system 101 in step 602. As with the occupied state signal, the reserved state signal has appropriate identifying information for the chair 300 and the wireless sensing device 304.

After a reserved state signal has been sent at step 602, a timer is activated at step 603. The timer activated at step 603 may be the same timer as described with regard to method 500 in FIG. 5. The timer may be housed in either the wireless sensing device 304 or the occupancy monitoring computer system 101. After the timer has been activated in step 603, it is determined if the timer has reached a second time threshold at step 604. If the timer has not reached the second time threshold, the timer is checked again. As will be appreciated, if the timer is housed in the wireless sensing device 304, then the timer will be checked in the wireless sensing device 304; however, if the timer is housed in the occupancy monitoring system 101, then the occupancy monitoring system 101 will check when the timer has reached the second time threshold. Additionally, if the timer has reached the second time threshold as determined by the occupancy monitoring computer system 101, then the occupancy monitoring computer system 101 will transmit a signal to the wireless sensing device 304 indicating that the timer has reached the second time threshold.

After the timer has reached the second time threshold, the wireless sensing device 304 further determines if the seat 302 is still moved from the first position at step 605. If the seat 302 has not moved back to the first position, then the wireless sensing device 304 transmits an available state signal to the occupancy monitoring computer system 101 at step 607 updating the occupancy status of the chair 300 from a reserved state to an available state. On the other hand, if the seat 302 has moved back to the first position, then the patron has returned to the seat 302 and the seat is no longer reserved or available.

Accordingly, in one embodiment, the wireless sensing device 304 sends an occupied state signal to the occupancy monitoring computer system 101 to update the occupancy status of the chair 300 from the reserved state back to the occupied state at step 606 when a patron returns to the chair 300. After transmitting the occupied state signal at step 606, the wireless sensing device 304 may enter a sleep or hibernation mode until it senses that the seat 302 has moved to a position as seen in FIG. 3A.

According to another embodiment, the timer in the occupancy monitoring system 101 continues to run after being activated at step 602, and if the timer reaches a reserved maximum time threshold which is greater than the second threshold, without receiving an available state signal from the wireless sensing device 304 at step 607, then the occupancy monitoring system 101 assumes the patron has returned to the chair 300 and changes the occupancy status from a reserved state to an occupied state.

It is also preferred that the occupancy monitoring computer system 101 have the most accurate and recent information regarding the occupancy status of the chairs in the seating areas. One example of accomplishing this is to ensure that the occupancy monitoring computer system 101 has received all chair status updates.

Figure 7:
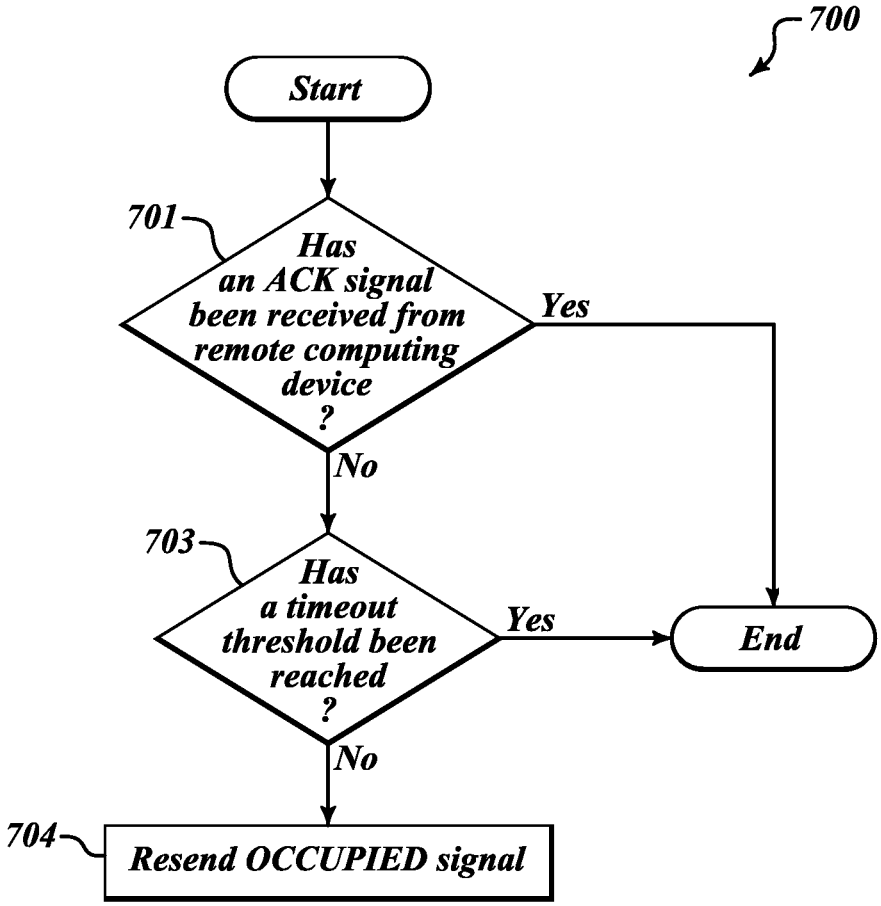
FIG. 7 is a method of determining that the occupancy monitoring system has accurate and recent information regarding the occupancy status of each chair in a seating area.

To determine if the occupancy monitoring computer system 101 has recent occupancy statuses from the chairs in the seating areas, the occupancy monitoring computer system 101 sends an acknowledgement signal back to the wireless sensing device 304 in response to a received occupancy status signal, including an occupied state signal. As seen in the method 700 of FIG. 7, an occupancy status signal has been sent from the wireless communication device 304 as describe with regards to either methods 500 and 600. After the wireless sensing device 304 has sent the occupied status signal, it is determined if an acknowledgement signal has been received from the occupancy monitoring computer system 101 at step 701 indicating receipt of the occupancy status signal. If an acknowledgement signal has been received, then the wireless sensing device 304 may enter a sleep or hibernation mode.

If no acknowledgement signal is received, then a timer is activated at the wireless sensing device 304. If a timeout threshold has not been reached at step 703, then the occupancy status signal is resent from the wireless communication device 304 at step 704. Otherwise, if the timeout threshold has been reached, then the wireless communication device 304 enters a sleep or hibernation mode until movement in the seat 301 is detected again.

In some embodiments, the occupancy monitoring computer system 101 may store and organize information related to the usage of the chairs over time. This information may be stored locally at the occupancy monitoring computer system 101 or may be stored at a location separate and remote from the occupancy monitoring computer system 101. Such information may be used as part of performing analytics and/or otherwise determining trends related to the usage of the chairs and the seating area. This may be valuable information to an organization that owns or manages the seating area to make decisions on how to use the seating area and the chairs. A theater owner can monitor more exactly the rate at which chairs fill up, which chairs fill up first, and which fill up last. The amount of time a patron sits in a chair until they leave, the amount of time a patron is gone from a chair before returning, and a number of other factors can also be monitored and stored in the occupancy monitoring computer system 101.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method comprising:

transmitting an occupied signal to a computing device when a moveable seat of a chair has moved to a first position;

activating a timer upon sensing that the moveable seat of the chair has moved to the first position; and changing a status of the chair from available to occupied after the computing device has received the occupied signal and the timer has reached a first threshold.

2. The method of claim 1, further comprising:

retransmitting the occupied signal to the computing device when an acknowledgement signal has not been received from the computing device within a period of time.

3. The method of claim 1, further comprising:

activating the timer upon sensing that the moveable seat of the chair has moved from the first position;

transmitting a reserved signal to the computing device that causes the status of the chair to change from occupied to reserved; and changing the status of the chair from reserved to available when the timer has reached a second threshold.

4. The method of claim 1, further comprising:

entering a sleep mode of a sensing device when the status of the chair has changed from available to occupied and an acknowledgement signal is received from the computing device.

5. The method of claim 3, further comprising:

entering a sleep mode after changing the status of the chair from reserved to available.

6. The method of claim 1, wherein the computing device communicates wirelessly.

7. The method of claim 3, wherein the first and second thresholds being of sufficient time to avoid erroneously changing the status of the chair.

8. The method of claim 1, wherein the timer is housed in the computing device.

9. The method of claim 1, wherein the timer is housed in a sensing device that is coupled to the chair.

10. A system comprising:

a sensing device coupled to a chair;

a timer that is activated when a seat of the chair is occupied by a patron;

a computing device capable of communicating with the sensing device, the sensing device transmitting an occupied signal to the computing device; and a display device capable of displaying real-time data including an occupancy status of the chair when the sensing device transmits the occupied signal to the computing device and the timer reaches a first threshold.

11. The system of claim 10, wherein the display device is further capable of displaying real-time data corresponding to a reserved state and an available state of the chair.

12. The system of claim 11, wherein the reserved state of the chair is entered from an occupied state when the sensing device senses the moveable seat of the chair is moved from the first position.

13. The system of claim 11, wherein the available state of the chair is entered from the reserved state when the timer has reached a second threshold after the status of the chair is changed to the reserved state.

14. The system of claim 10, wherein the display device is housed in a mobile display unit.

15. The system of claim 10, wherein the display device is further capable of displaying advertisements.

16. The system of claim 15, wherein the advertisements are received from at least one of the computing device and an advertisement server.

17. The system of claim 10, wherein the timer is housed in the sensing device.

18. The system of claim 10, wherein the timer is housed in the computing device.

19. A method comprising:

transmitting an occupied signal to a computing device when a moveable seat of a chair has moved to a first position;

activating a timer upon sensing that the moveable seat of the chair has moved to the first position;

changing a status of the chair from available to occupied after the computing device has received the occupied signal and the timer has reached a first threshold;

activating the timer upon sensing that the moveable seat of the chair has moved from the first position;

transmitting a reserved signal to the computing device that causes the status of the chair to change from occupied to reserved; and changing the status of the chair from reserved to available when the timer has reached a second threshold.

20. The method of claim 19, comprising retransmitting the occupied signal to the computing device when an acknowledgement signal has not been received from the computing device within a period of time.

* * * * *